US005949889A

United States Patent [19]

Cooper

[11] Patent Number: 5,949,889

[45] Date of Patent: Sep. 7, 1999

[54] DIRECTIONAL HEARING AID

[75] Inventor: Guy F. Cooper, Ventura, Calif.

[73] Assignee: The United States of America as represented by the Secretary of the Navy, Washington, D.C.

[21] Appl. No.: 08/922,075

[22] Filed: Sep. 2, 1997

[51] Int. Cl.[6] ..... H04R 25/00

[52] U.S. Cl. ..... 381/68.1; 381/313; 381/315; 381/328

[58] Field of Search ..... 381/23.1, 312, 381/314, 315, 316, 320, 321, 328, 60

[56] References Cited

U.S. PATENT DOCUMENTS

| | | | |
|---|---|---|---|
| 3,836,732 | 9/1974 | Johanson | 179/107 FD |
| 3,876,843 | 4/1975 | Moon | 179/107 FD |
| 3,946,168 | 3/1976 | Preves | 179/107 FD |
| 4,051,330 | 9/1977 | Cole | 179/107 FD |
| 4,447,677 | 5/1984 | Miyahra | 179/107 R |
| 4,751,738 | 6/1988 | Widrow | 381/68.1 |

*Primary Examiner*—Curtis A. Kuntz
*Assistant Examiner*—Dionne Harvey
*Attorney, Agent, or Firm*—David S. Kalmbaugh

[57] ABSTRACT

A directional hearing aid comprising a slave microphone for the right ear and a master microphone for the left ear, each of which receive audio information from an external source. The output signal from the master and slave microphones are each provided to fifty hertz bandwidth filters each of which has a center frequency selected from the middle range frequency of the human voice. The output signal from the slave microphone is provided to a modulator which then provides a sixty kilo-hertz frequency modulated carrier signal. The carrier signal is transmitted through the head of the user to a receiver, demodulated and then supplied to a phase comparator. The phase comparator compares the phase of the signals from the master and slave microphones and then provides phase comparison data to a computer. The computer processes the data generating command signals which are supplied to a pair of broad band audio amplifiers. One of the audio amplifiers amplifies the output signal from the slave microphone, while the other audio amplifier amplifies the output signal from the master microphone. The user of the directional hearing aid turns his head toward the direction of the sound until the intensity of the amplified signal provided to each ear is identical, which indicates to the user that his head is aligned with the direction of the incoming sound.

14 Claims, 2 Drawing Sheets

DIRECTIONAL HEARING AID

BACKGROUND OF THE INVENTION

1. Field of the Invention

The present invention relates generally to a hearing aid. More particularly, the present invention relates to a hearing aid that allows an individual with impaired hearing to locate a sound source in a noisy environment by sensing the direction of incoming audio sound.

2. Description of the Prior Art

It is known that under certain circumstances and for persons with a particular but not unusual type of hearing defect, that a hearing aid providing good directional response is very desirable. People whose hearing handicap is that they are deaf in one ear but have at least some minimal level of hearing in the other ear find it very difficult to tune into and understand a particular speaker or sound source in the presence of other background noise sources. Persons with such a single ear hearing loss are able to hear with their good ear, but are unable to differentiate and separate the sounds from various sources. In other words, they are able to hear but not to understand. This phenomenon is known as the "cocktail party" effect it makes it extremely difficult for a mono-aurally handicapped person to participate effectively in a situation with multiple sound sources such as at a group discussion.

Among the directional hearing aid devices proposed in the prior art, and currently commercially available, one which has achieved some popularity is known as the cross-aid device. This device consists basically of a subminiature microphone located on the user's deaf side, with the amplified sound piped into the good ear. While this compensates for deafness on one side, it is not very effective in reducing the problem of understanding a particular speaker or sound source in the presence of other background noise sources. Other efforts in the prior art have been largely directed to the use of moving, rotatable conduits which can be turned in the direction which the listener wishes to emphasize. Alternatively, efforts have also been made in using movable plates and grills to change the acoustic resistance and thus the directive effect of a directional hearing aid. None of these efforts have proved to be satisfactory. Old-fashioned ear trumpets has been effective in providing amplification and directionality, but they went out of favor with the advent of electronic hearing aids.

Accordingly, there is a need for an effective and efficient hearing aid which will allow an individual with impaired hearing to understand with clarity a particular speaker or sound source in the presence of other background noise sources.

SUMMARY OF THE INVENTION

The present invention overcomes some of the difficulties of the prior art including those mentioned above in that it comprises a relatively simple yet highly effective directional hearing aid that allows a user with impaired hearing to sense the direction of incoming audio sound to distinguish a coherent sound source from background noise.

The directional hearing aid of the present invention comprises a slave microphone for the right ear and a master microphone for the left ear, each of which receives audio information from external sources. The output signal from the master and slave microphones are each provided to identical fifty hertz bandwidth filters, each of which has a center frequency selected from the middle range frequency of the human voice, for example, from about 2000 to about 6000 hertz. The output signal from the slave microphone is provided to a modulator which then provides a sixty kilohertz frequency acoustic modulated carrier signal. The frequency modulated acoustic carrier signal is transmitted through the head of the user to a receiver, demodulated and then supplied to a phase comparator. The phase comparator compares the phase of the center frequency signals from the master and slave microphones and then provides phase comparison data to a computer. The computer processes the phase comparison data and generates command signals which are supplied to a pair of broad band audio amplifiers. One of the audio amplifiers amplifies the output signal from the slave microphone, while the other audio amplifier amplifies the output signal from the master microphone. The user of the directional hearing aid turns his head toward the direction of the sound until the intensity/sound level of the amplified signal provided to each ear is identical, which indicates to the user that his head is aligned with the direction of the incoming sound.

DETAILED DESCRIPTION OF THE PREFERRED EMBODIMENT

Figure 1:
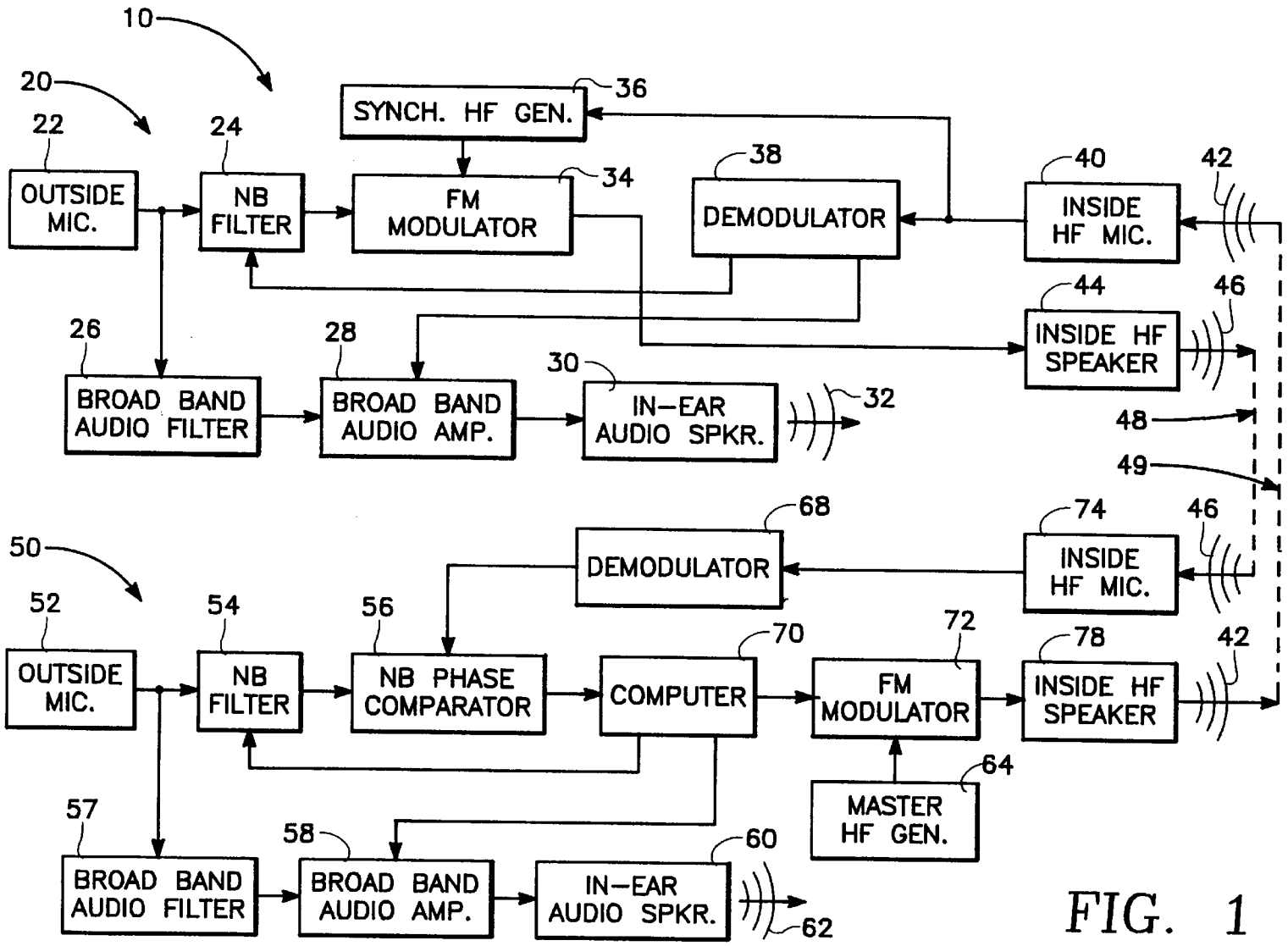
Figure 2:
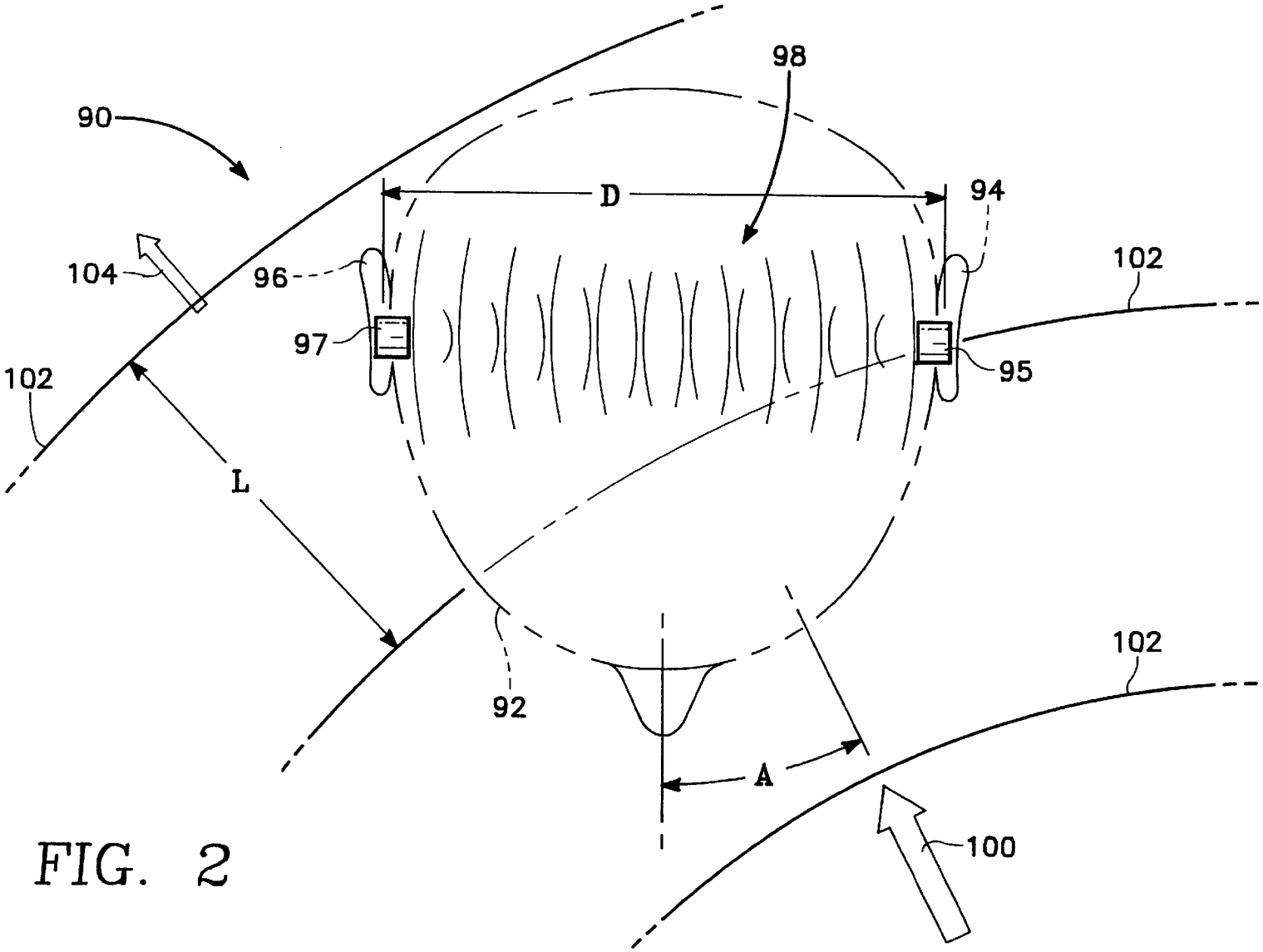

FIG. 1 is a detailed electrical schematic diagram of the directional hearing aid constituting the preferred embodiment of the present invention; and FIG. 2 is a schematic diagram illustrating the placement of certain electronic elements of the directional hearing aid of FIG. 1 within the ears of the wearer using as an example a coherent sound source originating from a specific direction.

DETAILED DESCRIPTION OF THE PREFERRED EMBODIMENT

Referring to FIGS. 1 and 2, there is shown an electrical schematic diagram of a directional hearing aid 10 which will allow an individual with impaired hearing to determine direction of a coherent sound source in a noisy environment. Directional hearing aid 10 allows the user 92 to determine the "look direction" of an incoming sound wavefront 102 regardless of whether an equal loss of sound sensitivity is between the ears 94 and 96 of wearer 102 or a loss altogether of sensitivity in both ears 94 and 96.

Directional hearing aid 10 comprises a slave hearing aid 20 and its associated electronic components as well as a master hearing aid 50 and its associated electronic components. Slave hearing aid 20 is adapted for the right ear 96 of user 92, while master hearing aid 50 is adapted for the left ear 94 of user 92.

It should be understood that either the left ear or the right ear can have master hearing aid 50 disposed therein, while the opposite ear can have slave hearing aid 20 disposed therein.

The slave hearing aid 20 includes a microphone 22 which detects sound in the audio frequency spectrum arriving at the right ear 96 of the user 92. Microphone 22 provides its output signal to a narrow band filter 24 and a broad band audio amplifier 26. Narrow band filter 24 has a frequency band width of about 50 hertz that is swept over the audio frequency spectrum at a sinusoidal sweep frequency of 20 kHz per second. The center frequency of filter 24 is determined by a command signal from demodulator 38.

Normally, for an individual with average hearing the audio frequency range is from about 30 hertz to about 16 kHz in normal people and for older people the audio frequency range is from about 50 hertz to 10 kHz. However, for the purpose of illustrating the operation of directional hearing aid 10 it may be assumed that filter 24 is swept from about 2 kHz to about 10 kHz.

FIG. 2 illustrates user 92 of directional hearing aid 10 receiving a single coherent source 100 of sound at an off normal angle A of about 26.5 degrees from an individual addressing the user 92 of directional hearing aid 10. The dominate frequency of sound source 100 is 3000 Hz, while the wave length, that is the distance between wavefronts 102 of source 100 is 4.46 inches at standard sea level conditions (59 degrees Fahrenheit).

Modulator 34 also has a synchronous high frequency signal generator 36 connected thereto. Synchronous high frequency signal generator 36 generates a 60 kHz carrier signal which is supplied to modulator 34. The 3000 hertz filtered signal is also supplied to a modulator 34. The 60 kHz carrier signal then has its frequency modulated by the 3000 hertz filtered signal. The 60 kHz frequency modulated carrier signal is next provided to a high frequency speaker 44 packaged in a casing 97 in the right ear 96 of the head of user 92. Speaker 44 broadcast along an audio path 48 through the head of user 92 an acoustic signal 46 having an identical waveform to the 60 kHz frequency modulated carrier signal provided to its input.

Packaged in a casing 95 in left ear 94 of user 92 is a high frequency microphone 74 which receives acoustic signal 46. Microphone 74 then converts acoustic signal 46 to an electrical equivalent 60 kHz frequency modulated carrier signal. Connected to high frequency microphone 74 is a demodulator 68 which demodulates the carrier signal to recover the 3000 hertz filtered signal as well as the phase of the signal.

Master hearing aid 50 includes an outside microphone 52 which also receives the wavefronts 102 of sound source 100. Microphone 52 provides at its output an electrical signal equivalent to the acoustic signal of sound source 100. Outside microphone 52 is connected to a narrow band filter 54. Narrow band filter 54 has a frequency band width of about 50 hertz and is swept over the audio frequency spectrum. Narrow band filter 54 is also swept at a sinusoidal sweep frequency of 20 kHz per second and has a center frequency which is determined by a command signal from computer 70. Filter 54 filters the electrical signal from microphone 52 to provide a 3000 hertz filtered signal which lags in phase, that is this signal is out of phase by about 180 degrees from the 3000 hertz filtered signal from demodulator 68.

At this time, it should be noted that for the sound source 100 the phase of wavefront 102 arriving at left ear 94 of user 92 is 0 degrees, while the phase of wavefront 102 arriving simultaneously at the right ear 96 of user 92 is −179.2 degrees. It should also be noted that wavelength L for the 3000 kHz sound signal 100 (FIG. 2) is 4.46 inches and the ear to ear distance D is about 6.1 inches.

Filter 54 and demodulator 68 are each connected to a phase comparator 56 which compares the phase of the filtered 3000 kHz signal from filter 54 with the phase of the filtered 3000 kHz signal from demodulator 68. Phase comparator 56 then provides an electrical signal to a computer 70 which is representative of the phase difference between the signals from filter 54 and demodulator 68. Computer 70, responsive to this electrical signal, generates a plurality of command signals which are supplied directly to broad band audio amplifier 58 and indirectly to broad band amplifier 28.

The command signals for broad band amplifier 28 are first supplied to a modulator 72 which is also connected to a high frequency signal generator 64. Generator 64 provides a 75 kHz carrier signal to modulator 72 which frequency modulates the 75 kHz carrier signal with the command signals from computer 70. The 75 kHz frequency modulated carrier signal is next provided to a high frequency speaker 78 packaged in a casing 97 in the left ear 94 of the head of user 92. Speaker 78 broadcast along an audio path 49 an acoustic signal 42 having an identical waveform to the 75 kHz frequency modulated carrier signal provided to its input. Packaged in casing 97 in right ear 96 of user 92 is a high frequency microphone 40 which receives acoustic signal 42. Microphone 40 then converts acoustic signal 42 to an electrical equivalent 75 kHz frequency modulated carrier signal. Connected to high frequency microphone 40 is a demodulator 38 which demodulates the carrier signal to recover the command signals provided by computer 70.

Demodulator 38, which is connected to broad band audio amplifier 28 and filter 24, provides the command signals from computer 70 to amplifier 28 and filter 24.

The amplitude of the audio output signal from broad band audio amplifier 28 is adjusted either upward or downward in response to the command signals from computer 70. In a like manner, the amplitude of the audio output signal from broad band audio amplifier 58 is adjusted either upward or downward in response to the command signals from computer 70.

To align himself with the direction of arrival of sound source 100, user 92 will need to turn his head to the left. Directional hearing aid 10 provides an audio signal 62 via an in ear audio speaker 60 in left ear 94 which is loader than the audio/sound signal 32 provided by an in ear audio speaker 30 in right ear 96 of user 92. This difference in the volume or magnitude of the audio/sound signals 32 and 62 indicates that the user 92 is to turn his head to the left until the volume of audio signal 32 is equal to the volume of audio signal 62. When the volume of audio signal 62 in the left ear 94 is equal to the volume of the audio signal 32 in the right ear 96, the head of user 92 is aligned with the direction of arrival of wavefronts 102 of sound source 100.

Microphone 40 is also connected to high frequency signal generator 36 to provide the 75 kHz frequency modulated carrier signal to generator 36 so as to insure that the 60 kHz and 75 kHz signals are synchronized.

Each of the broad band audio filters 26 and 57 are adapted to bring the right and left ears of the wearer 22 within a normal hearing profile in the audio frequency spectrum. Filter 26 which receives the output signal of microphone 22 and filter 57 which receives the output signal of microphone 57 attenuate only the frequencies within the audio frequency spectrum where user 92 has normal hearing. For example, if the user's hearing is defective in right ear 96 in the 8–10 kHz range of the audio frequency spectrum, filter 26 will attenuate frequencies below 8 kHz and above 10 kHz. In a like manner, if the user's hearing is defective in left ear 94 in the 8–10 kHz range filter 57 will attenuate frequencies below 8 kHz and above 10 kHz.

At this time, it should be noted that the command signal from computer 70 which sets the center frequency of filter 54 is supplied directly to filter 54. It should also be noted that the command signal from demodulator 38 which sets the center frequency of filter 24 is supplied indirectly from computer 70 to demodulator 38 via the 75 kHz frequency modulated carrier signal generated by modulator 72. Demodulator 38 then recovers the command signal from the 75 kHz frequency modulated carrier signal prior to supplying the signal to narrow band filter 24.

It should be understood that the center frequency of 3000 kHz is illustrative. Other center frequencies may be selected and processed by directional hearing aid 10 in the manner described above. For example, a center frequency of 2000 kHz may be selected for processing by directional hearing aid 10.

From the foregoing, it may readily be seen that the present invention comprises a new, unique and exceedingly useful hearing aid that allows an individual with impaired hearing to sense the direction of incoming audio sound which constitutes a considerable improvement over the known prior art. Obviously many modifications and variations of the present invention are possible in light of the above teachings. It is therefore to be understood that within the scope of the appended claims that the invention may be practiced otherwise than as specifically described.

What is claimed is:

1. A directional hearing aid for allowing a user of said directional hearing aid to orientate a head of the user to a direction of incoming audio information, said directional hearing aid comprising:

a first external microphone disposed in a right ear of said user, said first external microphone receiving said incoming audio information and then converting said incoming audio information to a first audio output signal;

a second external microphone disposed in a left ear of said user, said second external microphone receiving said incoming audio information and then converting said incoming audio information to a second audio output signal;

first filtering means for bandpass filtering said first audio output signal to provide a first filtered audio signal;

second filtering means for bandpass filtering said second audio output signal to provide a second filtered audio signal, a center frequency for said first filtering means and said second filtering means being selected within a predetermined range of the audio frequency spectrum;

first modulating means for frequency modulating a first carrier wave with said first filtered audio signal to provide a first frequency modulated carrier signal;

first broadcasting means for broadcasting said first frequency modulated carrier signal through the head of said user, said first broadcasting means being disposed in the right ear of said user;

first receiving means disposed in the left ear of said user to receive said first frequency modulated carrier signal;

first demodulating means for demodulating said first frequency modulated carrier signal to recover said first filtered audio signal;

phase comparison means for comparing the phase of said first filtered audio signal to the phase of said second filtered audio signal to a phase difference between the phase of said first filtered audio signal and the phase of said second filtered audio signal, said phase comparison means providing a phase comparison signal representative of said phase difference;

computer means for receiving and processing said phase comparison signal to generate a plurality of command signals;

second modulating means for frequency modulating a second carrier wave with a first and a second of said plurality of command signals to provide a second frequency modulated carrier signal;

second broadcasting means for broadcasting said second frequency modulated carrier signal through the head of said user, said second broadcasting means being disposed in the left ear of said user;

second receiving means disposed in the right ear of said user to receive said second frequency modulated carrier signal;

second demodulating means for demodulating said second frequency modulated carrier signal to recover said the first and the second of said plurality of command signals;

said first filtering means receiving the first of said plurality of command signals, said second filtering means receiving a third of said plurality of command signals, the center frequency for said first and said second filtering means respectively being selected in response to the first and the third of said plurality of command signals;

first amplifying means for receiving the second of said plurality of command signals, said first amplifying means, responsive to the second of said plurality of command signals, amplifying said first audio output signal to provide an amplified first audio output signal;

second amplifying means for receiving a fourth of said plurality of command signals, said second amplifying means responsive to the fourth of said plurality of command signals, amplifying said second audio output signal to provide an amplified second audio output signal;

a first audio speaker disposed in the right ear of said user, said first audio speaker being coupled to said first amplifying means to receive said amplified first audio output signal and convert said amplified first audio output signal to a first sound signal;

a second audio speaker disposed in the left ear of said user, said second audio speaker being coupled to said second amplifying means to receive said amplified second audio output signal and convert said amplified second audio output signal to a second sound signal;

the user of said directional hearing aid being orientated to the direction of said incoming audio information when the intensity of said first sound signal equals the intensity of said second signal.

2. The directional hearing aid of claim 1 wherein the center frequency of said first filtering means and the center frequency of said second filtering means are each 3000 hertz.

3. The directional hearing aid of claim 1 wherein the center frequency of said first filtering means and the center frequency of said second filtering means are each 2000 hertz.

4. The directional hearing aid of claim 1 wherein said first modulating means comprises a frequency modulation modulator.

5. The directional hearing aid of claim 1 wherein said second modulating means comprises a frequency modulation modulator.

6. The directional hearing aid of claim 1 further comprising a synchronous signal generator having an input connected said second receiving means and an output connected to said modulating means.

7. The directional hearing aid of claim 1 further comprising a master signal generator having an output connected to said second modulating means.

8. A directional hearing aid for allowing a user of said directional hearing aid to orientate a head of the user to a direction of incoming audio information, said directional hearing aid comprising:

a first outside microphone disposed in a right ear of said user, said first outside microphone having an output;

a second outside microphone disposed in a left ear of said user, said second outside microphone having an output;

a first narrow band filter having a first input connected to the output of said first outside microphone, a second input and an output;

a second narrow band filter having a first input connected to the output of said second outside microphone, a second input and an output;

a first modulator having a first input connected to the output of said first narrow band filter, a second input and an output;

a first inside speaker disposed in said right ear of said user, said first inside speaker having an input connected to the output of said first modulator;

a first inside microphone disposed in said left ear of said user, said first inside microphone having an output;

a first demodulator having an input connected to the output of said first inside microphone and an output;

a phase comparator having a first input connected to the output of said first demodulator, a second input connected to the output of said second narrow band filter and an output;

a computer having an input connected to the output of phase comparator, a first output connected to the second input of said narrow band filter, a second output and a third output;

a second modulator having a first input connected to the second output of said computer, a second input and an output;

a second inside speaker disposed in said left ear of said user, said second inside speaker having an input connected to the output of said second modulator;

a second inside microphone disposed in said right ear of said user, said second inside microphone having an output;

a second demodulator having an input connected to the output of said second inside microphone, a first output connected to the second input of said first narrow band filter and a second output;

a first broad band audio filter having an input connected to the output of said first outside microphone and an output;

a first broad band audio amplifier having a first input connected to the output of said first broad band audio filter, a second input connected to the second output of said second demodulator and an output;

a first audio speaker disposed in said right ear of said user, said first audio speaker having an input connected to the output of said first broad band audio amplifier;

a second broad band audio filter having an input connected to the output of said second outside microphone and an output;

a second broad band audio amplifier having a first input connected to the output of said second broad band audio filter, a second input connected to the third output of said computer and an output; and a second audio speaker disposed in said left ear of said user, said second audio speaker having an input connected to the output of said second broad band audio amplifier.

9. The directional hearing aid of claim 8 wherein said first narrow band filter has a bandwidth of about fifty hertz and a center frequency selected from a range of 2000 hertz to about 6000 hertz.

10. The directional hearing aid of claim 8 wherein said second narrow band filter has a bandwidth of about fifty hertz and a center frequency selected from a range of 2000 hertz to 6000 hertz.

11. The directional hearing aid of claim 8 wherein said first modulator comprises a frequency modulation modulator.

12. The directional hearing aid of claim 8 wherein said second modulator comprises a frequency modulation modulator.

13. The directional hearing aid of claim 8 further comprising a synchronous signal generator having an input connected to the output of said second inside microphone and an output connected to the second input of said first modulator.

14. The directional hearing aid of claim 8 further comprising a master signal generator having an output connected to the second input of said second modulator.

* * * * *